US005398937A

United States Patent [19]

Regan

[11] Patent Number: 5,398,937

[45] Date of Patent: Mar. 21, 1995

[54] GOLF SWING TRAINING DEVICE

[76] Inventor: Daniel V. Regan, 6620 Belmont, Houston, Tex. 77005

[21] Appl. No.: 132,206

[22] Filed: Oct. 6, 1993

[51] Int. Cl.[6] ..... A63B 69/36

[52] U.S. Cl. ..... 273/186.1; 273/187.1; 273/DIG. 30

[58] Field of Search ..... 273/DIG. 30, 187 R, 273/187.1, 186.1; 33/508

[56] References Cited

U.S. PATENT DOCUMENTS

| | | | |
|---|---|---|---|
| 2,025,519 | 12/1935 | Lingg | 273/187 R X |
| 2,790,642 | 4/1957 | Rolfe | 273/187 R |
| 3,094,330 | 6/1963 | Smith | 273/DIG. 30 |
| 3,580,584 | 5/1971 | Trosko | 273/187 R X |
| 4,478,422 | 10/1984 | Blanchard | 273/187 R |
| 5,141,232 | 8/1992 | Durso | 273/DIG. 30 |

*Primary Examiner*—George J. Marlo
*Attorney, Agent, or Firm*—John S. Egbert

[57] ABSTRACT

A golf swing training device including a first strip, a second strip pivotally connected to the first strip, a tee extending upwardly from the first and second strips, a block affixed to an end of the first strip, a plurality of hook-and-loop material sections affixed in spaced intervals on a surface of the block, and a strip of complementary hook-and-loop material attached to an end of the second strip. The strip of complementary hook-and-loop material is removably affixed to one of the plurality of hook-and-loop material sections. The tee is a rubberized tee mounted at a point of pivotal connection of the first strip with the second strip. Each of the first and second strips are linear members having a tapered end opposite the block.

9 Claims, 1 Drawing Sheet

GOLF SWING TRAINING DEVICE

TECHNICAL FIELD

The present invention relates to devices for training the swing of a golfer. More particularly, the present invention relates to golf swing training devices that have a target arrow and a swing arrow.

BACKGROUND ART

The game of golf is rapidly growing in popularity, both in the United States and elsewhere around the world. As a result, of the rapid growth and the number of individuals playing the game of golf, there is a corresponding increase in the number of relatively inexperienced players. These players are constantly struggling with their games. Indeed, beginners may find that the game is frustrating and not enjoyable.

At the same time, more experienced players are becoming more and more interested in improving their games. As a player increases in experience and technique, it often becomes desirable for the player to learn to hit shots other than simple straight shots. Such shots are often referred to as hook or draw shots in the event the ball travels in an arc in the general direction of the swing. When the ball travels in an arc away from the direction of the swing, the shot is referred to as a slice or fade shot.

There are a number of factors involved in hitting any golf shot, whether the shot be straight, or a hook, or a slice. One factor is the stance, or the position of the golfer's feet with respect to the ball. In order to obtain a desirable shot, the stance or foot position of the golfer must be proper. It is similarly important that the swing of the golf club be in the correct direction. This is sometimes referred to as the swing line. In order to hit any golf shot in the correct direction, it is necessary that the swing line (or the path of club travel) be proper.

In order to improve one's golf game, many people engage golf professionals as instructors. Such instruction is useful in developing good form and a solid, competitive game. However, golf instruction is expensive and time consuming. Accordingly, most people limit the amount of time actually spent with a golf professional. Even if lessons are taken, the individual golfer will spend most of his golfing time playing or practicing the game outside of the supervision of the golf professional. During these times, it may be difficult to maintain good form and to avoid destructive habits.

In order to facilitate development of a person's golf game, various devices have been developed in order to aid in practicing, without developing problems with a person's golf stroke. A number of these devices include means for positioning the golfer's feet such that a proper stance is maintained. These devices may take the form of a mat that lies on the ground or they may be constructed of a series of elongated rods that are adjusted in order to indicate the proper foot position for the golfer. While some of these devices also provide some indication as to the recommended location of the ball, they generally do not aid in directing the golfer's swing. Most of these devices do not indicate a swing line.

Some well known practice mats combine the ability to indicate the appropriate stance with some type of indication of the proper path of the golf club. However, most of these mats are specifically designed to constitute permanent or semi-permanent fixtures at a practice range or putting green. Most of these mats are not mobile and, thus, do not provide any aid to the golfer who seeks to practice on the actual golf course.

As the golfer's game improves and increases in sophistication, the golfer often desires the ability to hit the golf ball over a curved path, as well as in a straight line. This allows the golfer the ability to hit around obstacles such as sand traps, trees, and water hazards. It also provides the golfer with the ability to hit the ball along curved (dogleg) fairways. This skill requires that the golfer be able to adjust his stance and swing line. Very few novice golfers have the ability to make such shots on command. Known golf aid devices fail to provide significant help in making such a shot. In the past, a large number of patents have issued with respect to golf swing training devices. For example, U.S. Pat. No. 3,542,369, issued on Nov. 24, 1970, to K. W. Andersen describes a portable golf practice mat. This device utilizes a tee with a wide base extending upwardly through a centrally located hole in the mat. Indicia are provided on the plastic material to show the direction of the target and the path that the head of the club should follow so as to drive a ball from the tee to the target. Additional indicia show the proper position of the Sollet's feet.

U.S. Pat. No. 3,861,764, issued on Feb. 9, 1971, to R. A. Thomas teaches a golf swing corrective mat which is a panel structure that defines s pair of generally straight visually ascertainable paths inclined approximately twenty-five to thirty degrees relative to each other and intersecting at one pair of corresponding ends. The ball is teed up on s first of the paths at a point spaced from the intersecting ends of the paths. The non-intersecting end portion of the first path extends in the intended tee shot direction. A visual guide is defined by the second path so as to assist the golfer in swinging "out and through" when swinging at the teed ball.

U.S. Pat. No. 3,580,584, issued on May 25, 1971, to D. P. Trosko provides s practice device for golfers for teaching the basic principles of driving. The device includes a flexible rope or cord for defining an arc of travel for a golf club head. A cross rod is provided so as to define the position of the player's feet. A forward extending rod extends from the cross rod. A straight bar extends from the plastic golf ball-supporting cup into the direction toward the green.

U.S. Pat. No. 3,679,206, issued on Jul. 25, 1972, to H. G. Shambaugh discloses a device for siding in the playing of golf. The device indicates the proper alignment of the club and the line of swing to compensate for the inclination of the sidehill. The device includes a base formed of pivotally connected members which define a first plane and a pointer element which extends upwardly from the base. When the pointer element is aligned along the line of sight from the ball to the point where the ball is to be hit, an indicator element is positioned in the plane of the base so as to lie parallel to the line of swing. This results in a line of flight of the ball along the above-mentioned line of sight. The pointer element is adjustable to various marked positions which are functionally related to the lofts of the various club heads used in striking golf balls.

U.S. Pat. No. 3,920,248, issued on Nov. 18, 1975, to J. K. Medders provides a golf swing training device that includes crossed flexible tapes which are stitched in the middle to form a central pad on which a golf ball is located. One of the tapes is stitched to form a loop in which is located a large metal D-ring on which is looped an adjustable tape which may be moved along the curvature of the D-ring. The tapes are spread out straight and evenly and fastened on the ground by a golf tee located in a grommet on the ends of each tape so as to form four legs along the ground, one of which is adjustable. The golfer stands on one side or the other, depending on whether the swing is right or left hand, and swings to follow the line of the tape to hook or slice or correct the swing by adjusting the tape.

U.S. Pat. No. 4,034,991, issued on Jul. 12, 1977, to J. Oppenheimer teaches a swing training apparatus in which a weighted member is secured to another member for guiding the weighted member through a predetermined path. A pair of flexible cords are secured to a pair of spaced apart posts and engage both the weighted member and the device to be swung with one of the cords secured at its other end to the device to be swung and the other to the weighted member. As the user swings the device to be swung, the weighted member is caused to traverse the predetermined path so as to cause the flexible cords to become taut or slacked at predetermined points throughout the swing. This causes the golf club to accelerate at a maximum speed through a desired point and to assume a desired position while moving at the maximum speed.

U.S. Pat. No. 4,478,422, issued on Oct. 23, 1984, to V. F. Blanchard teaches a golf practicing aid which includes a cord having a plurality of graduated segments. The ends of each segment are defined by eyelets through which tees may be inserted so as to secure the cord to the ground in a "figure four" configuration. The ball is placed within the confines of the triangular portion and its location is marked by a pair of clips. The segment of the triangular portion which corresponds to a hypotenuse includes graduations spaced further apart than the graduations of the segment forming the base of the triangular portion.

U.S. Pat. No. 4,583,738, issued on Apr. 22, 1986 provides a golf swing training apparatus that includes a base member, a timing means for emitting rhythmical tones which correspond to the various phases of s golfing swing, a guiding means for directing the movement of a golf club in a predetermined swing plane, and a positioning means for controlling the bodily movements of a golfer within a prescribed position during the golf swing.

U.S. Pat. No. 4,583,739, issued on Apr. 22, 1986, to R. Kabbany describes a golfer's stance positioning device. This device has a pair of elongated members pivotally secured to one another and pivotable within an operable position and a collapsed, inoperable position. The members include sets of indicia to define foot placement and ball placement for a particular club. A connector element enables one elongated member to be slidably adjusted therein while being pivotable relative to the other elongated member. An opening in the upper surface of the connector enables the golfer to view golf club identification indicia on one elongated member so that proper ball placement can be achieved for a particular club.

U.S. Pat. No. 4,911,450, issued on Mar. 27, 1990, to B. Rabold shows a golf swing teaching device having a clubhead on one end and a grip on the other end. A grip end light is mounted in the grip to produce a light that is colinear with the longitudinal axis of the shaft. A clubhead light is mounted in the clubhead to provide a light that is directly below the clubhead bottom edge and which is oriented at 90 degrees to the bottom edge of the clubhead so that the clubhead light is located centrally between the heel and toe directly beneath the clubhead. A swing track includes paths to be traversed by the grip end light and the clubhead light during the various phases of the golf swing.

U.S. Pat. No. 5,060,952, issued on Oct. 29, 1991, to E. F. Brill provides a self-contained putting aid. This aid includes an elongated rail having a generally U-shaped cross-section. An elongated, flexible aiming strip is connected to the rail through a parallelogram linkage so that the strip can be moved from an operative position, where it is in spaced, parallel relationship to the rail, to an inoperative position, where it is located within the rail. An end of the strip is formed with a hole to support a golf ball, and a movable backstroke guide is mounted on the strip and serves as a guide for the length of the backstroke.

U.S. Pat. No. 5,108,106, issued on Apr. 28, 1992, to R. M. Cook describes a gold alignment template. This template has a generally oval shaped body defining an upper portion and a lower portion. The body further includes a rearwardly projecting arm and a front foot guide attached to the front of the body, with a rear foot guide slidably attached to the rearwardly projecting arm. The upper portion of the body defines a golf swing line. The lower portion of the body defines a golf stance line. Also attached to the body is a golf ball positioning arm rotatably and slidably attached to the lower portion of the body. The device includes markings on the lower portion and the upper portion such that the ball positioning arm can be properly aligned for predetermined golf shots.

It is an object of the present invention to provide a golf swing training device that aids the golfer in getting the feel of the proper swing and to develop a groove in the swing.

It is another object of the present invention to provide a golf swing training device that is simple to use, compact, convenient, portable, and inexpensive.

It is a further object of the present invention to provide a golf swing training device that can quickly improve the golfer's swing without the necessity of expensive lessons.

It is a further object of the present invention to provide a golf swing training device that is relatively easy to manufacture.

These and other objects and advantages of the present invention will become apparent from a reading of the attached specification and appended claims.

SUMMARY OF THE INVENTION

The present invention is a golf swing training device that comprises a first strip, a second strip pivotally connected to the first strip, a block connected to an end of the first strip, and a means for fixing an end of the second strip to the body. The first and second strips are linear members having an arrow formed on each end opposite the block. The first strip extends perpendicular to the block. The second strip is pivotally connected to the first strip distal the block.

A tee extends upwardly from a surface of one of the first and second strips. The tee is a rubberized tee that is positioned distal the block at the point of pivotal connection of the first strip with the second strip.

The block includes gripping teeth formed on a surface opposite the means for fixing. The means for fixing includes a plurality of hook-and-loop material sections positioned on a surface of the block. The sections are positioned at intervals along the surface. These intervals correspond to an angular displacement of the second strip with respect to the first strip. The means for fixing also includes a strip of complementary hook-and-loop material affixed to an end of the second strip. The strip is removably attached to one of the sections of hook-and-loop material on the block.

The first strip is connected centrally to the block. The sections are positioned on the block on opposite sides of the first strip. In normal use, the first strip will form a target line to the hole (or desired ball placement direction). The second strip serves as the "swing line".

DETAILED DESCRIPTION OF THE INVENTION

Figure 1:
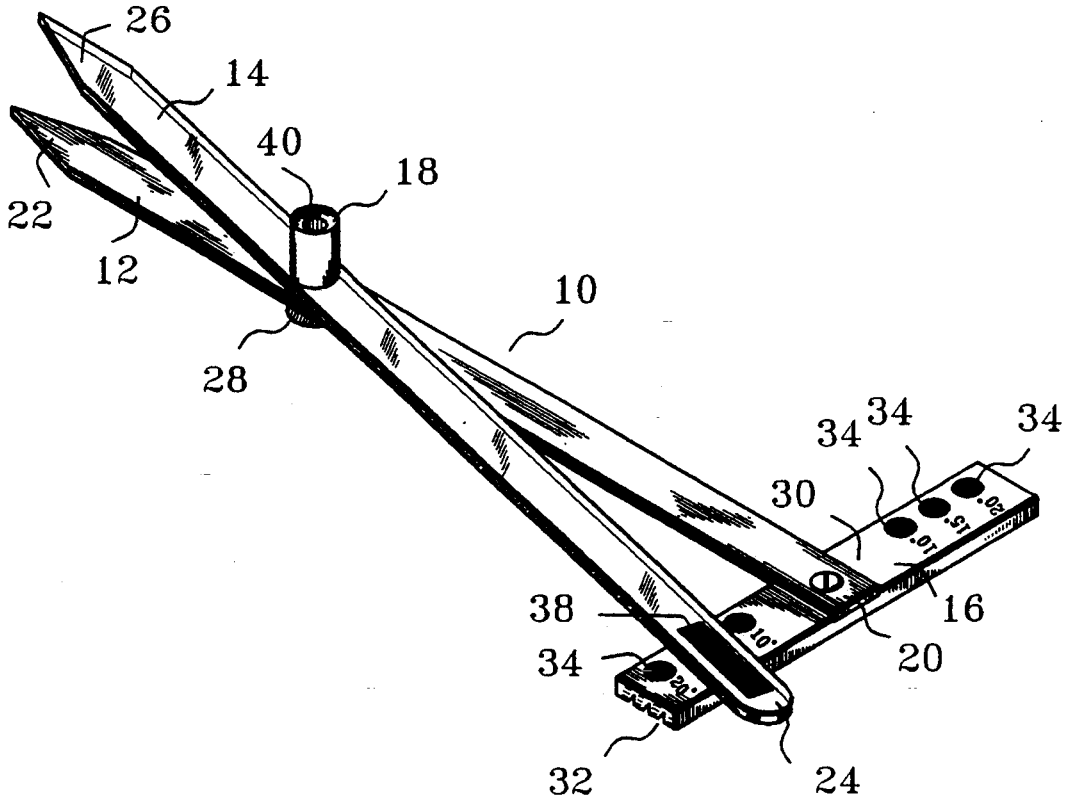
FIG. 1 is a perspective view showing the golf swing training device in accordance with the preferred embodiment of the present invention.

Referring to FIG. 1, there is shown at 10 the golf swing training device in accordance with the preferred embodiment of the present invention. The golf swing training device 10 includes a first strip 12, a second strip 14, a block 16, and a tee 18. In the present invention, there is also provided means for fixing an angular displacement of the second strip 14 with respect to the first strip 12.

In FIG. 1, it can be seen that the first strip 12 is a rigid linear strip that extends from the block 16 in generally perpendicular relationship thereto. The end 20 of the first strip 12 is affixed centrally of the block 16. The first strip 12 is a generally flat strip that can be made of high impact polystyrene or polyvinyl chloride. In normal use, the first strip 12 serves as the "target line". An arrow 22 is formed at the end of the first strip 12 opposite the block 16. The arrow 22 is directed toward the desired target. The second strip 14 has a similar configuration as that of the first strip 12. The second strip 14 is a linear member having an end 24 adjacent the block 16 and an opposite end 26. The opposite end 26 is an arrow-shaped end. The second strip 14 is pivotally connected at 28 to the first strip 12. As can be seen, the tee 18 is positioned at this point 28 of pivotal connection between the first strip 12 and the second strip 14. The arrow end 26 of the second strip 14 is "aimed" in the direction of the swing. As such, the second strip 14 serves as the "swing line" indicator. For the purposes of illustration, the second strip 14 is shown as made of a clear material.

The block 16 is rigidly affixed to the end 20 of the first strip 12. The block 16 is a generally rectangular block having a top surface 30 and a bottom surface 32. It can be seen that the bottom surface 32 includes a plurality of gripping teeth formed therein. The gripping teeth on the bottom surface 32 can engage the turf on a golf course so as to provide for secure connection of the device 10 with the earth. The top surface 30 receives the end 20 of the first strip 12 centrally thereon. A plurality of hook-and-loop material sections 34 are positioned on the top surface 30. These hook-and-loop material sections are positioned at spaced intervals on the top surface 30. Each of the spaced intervals corresponds to an angular displacement of the second strip 14 with respect to the first strip 12. As can be seen in FIG. 1, the end 24 of the second strip 14 covers the hook-and-loop material section 34 that corresponds to fifteen degrees displacement of the second strip 14 with respect to the first strip 12. The sections 34 on the top surface 30 serve as the "means for fixing" in the present invention.

Additionally, a strip 38 of complementary hook-and-loop material is affixed to the bottom surface of the end 24 of the second strip 14. In FIG. 1, the second strip 14 is illustrated in clear view so as to show where the strip 38 is positioned relative to the block 16. The strip 38 is suitable for attachment to the hook-and-loop material sections 34 on the surface 30 of block 16. By adhering the strip 38 to at least one of the sections 34, the angular displacement of the second strip 14 with respect to the first strip 12 is secured. As a result, the device 10 can be moved and positioned, as desired, without losing the predetermined relationship of the swing line (represented by the second strip 14) with the target line (represented by the first strip 12).

The tee 18 is a rubberized tee that has a golf ball receptacle 40 positioned in a top surface of the tee 18. The golf ball receptacle 40 extends upwardly above a top surface of the first strip 12 and the second strip 14. The tee 18 is generally centered along the strips 12 and 14. The use of a rubberized tee allows the tee 18 to be properly used without fear of breakage or destruction.

In the present invention, it should be noted that the sections 34 may be made of a color-coated VELCRO (TM) material. Also, alternatively, the sections 34 can be replaced by a continuous strip of hook-and-loop material. The angular displacement indicia (i.e. 10°, 15°, 20°) can be replaced by various other types of indicia.

In normal use, the golfer will align himself with the first strip (the "target line") while swinging the golf club in the direction indicated by the second strip 14 (the "swing line") so as to get the feel of the "inward outward" swing necessary to effectively control the golf ball. Those persons who are successful at golf develop a "grooved" or consistent swing. The present invention allows the golfer to "get the feel" of the proper swing to either prevent or eliminate inadequate swing technique. The present invention enables the individual to develop this swing in a consistent, simple, and effortless manner. The present device can be used without the assistance of professional instruction or the expense of such instruction. The golf swing training device 10 of the present invention is compact, convenient, easy to use, and inexpensive.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A golf swing training device comprising:

a first strip;

a second strip pivotally connected to said first strip, said first and second strips being linear members;

a block connected to an end of said first strip, each of said first and second strips having a tapered end opposite said block, said second strip pivotally connected to said first strip at a point distal said block;

a tee extending directly upwardly from a surface of one of said first and second strips, said tee positioned at a point of pivotal connection of said first strip with said second strip; and means for fixing an end of said second strip to said block, said means for fixing attached to a surface of said block.

2. The device of claim 1, said block having gripping teeth formed on a surface opposite said means for fixing.

3. The device of claim 1, said means for fixing comprising:

a plurality of hook-and-loop material sections positioned on said surface of said block, said sections positioned at intervals along said surface, said intervals corresponding to an angular displacement of said second strip with respect to said first strip.

4. The device of claim 3, said means for fixing further comprising:

a strip of complementary hook-and-loop material affixed to an end of said second strip, said strip of complementary hook-and-loop material removably attached to one of said sections of said hook-and-loop material on said surface of said block.

5. The device of claim 4, said first strip connected centrally to said block, said sections positioned on said block on opposite sides of said first strip.

6. A golf swing training device comprising:

a first strip having a tapered end;

a second strip pivotally connected to said first strip;

a rubberized tee extending directly upwardly from a surface of one of said first and second strips at a point of pivotal connection of said first strip with said second strip, said rubberized tee having a golf ball receptacle positioned above said first and second strips; and a block affixed to an end of said first strip opposite said tapered end, said block having attached thereto a means for fixing an angular displacement of said second strip with respect to said first strip.

7. The device of claim 6, said means for fixing comprising:

a plurality of hook-and-loop material sections affixed to said surface; and a strip of complementary hook-and-loop material attached to an end of said second strip, said strip of complementary hook-and-loop material removably secured to one of said sections of said hook-and-loop material.

8. The device of claim 7, said first strip extending outwardly perpendicular to said block, said second strip freely rotatable with respect to said first strip.

9. A golf swing training device comprising:

a first strip;

a second strip pivotally connected to said first strip;

a rubberized tee extending directly upwardly from said first and second strips, said tee mounted at a point of pivotal connection of said first strip with said second strip;

a block affixed to an end of said first strip, each of said first and second strips being linear members having a tapered end opposite said block;

a plurality of hook-and-loop material sections affixed in spaced intervals along a surface of said block; and a strip of complementary hook-and-loop material attached to an end of said second strip opposite the tapered end, said strip of complementary hook-and-loop material removably affixed to one of said plurality of hook-and-loop material sections.

* * * * *